United States Patent [19]

Ferka

[11] Patent Number: 4,852,590

[45] Date of Patent: Aug. 1, 1989

[54] INSERTABLE CIGARETTE SMOKE BAFFLE FOR HOLDERS

[76] Inventor: Robert Ferka, 2018 S. 40th St., San Diego, Calif. 92113

[21] Appl. No.: 215,993

[22] Filed: Jul. 7, 1988

[51] Int. Cl.[4] ..... A24F 1/16; A24F 1/04; A24F 1/02

[52] U.S. Cl. ..... 131/210; 131/198.1; 131/198.2; 131/216; 131/331; 131/339

[58] Field of Search ..... 131/198.1, 198.2, 210, 131/216, 331, 339

[56] References Cited

U.S. PATENT DOCUMENTS

| | | | |
|---|---|---|---|
| 2,385,651 | 9/1945 | Ricketts | 131/210 |
| 2,575,488 | 11/1951 | Carlson | 131/210 |
| 3,318,316 | 5/1967 | Banderas et al. | 131/339 X |
| 3,441,029 | 4/1969 | Wall | 131/198.2 |
| 3,468,316 | 9/1969 | Baum et al. | 131/210 |
| 3,631,866 | 1/1972 | Bottazzi | 131/210 |
| 3,926,199 | 12/1975 | Thomas | 131/198.1 X |
| 4,202,358 | 5/1980 | Drapaniotis | 131/210 X |

*Primary Examiner*—Vincent Millin
*Assistant Examiner*—Joe H. Cheng
*Attorney, Agent, or Firm*—Selwyn S. Berg

[57] ABSTRACT

A baffle for filtering cigarette smoke is described. The baffle is inserted into commonly available cigarette holders. The cleansing and filtering action of the baffle system is augmented by the throttling of the smoke in successive chambers which were created by the walls of the baffle and the interior of the cigarette holder. The successive chambers are interconnected by orifices.

1 Claim, 1 Drawing Sheet

INSERTABLE CIGARETTE SMOKE BAFFLE FOR HOLDERS

SUMMARY OF INVENTION

The smoking of cigarettes is enjoyed worldwide. Investigations have disclosed that smoking becomes habitual and those who do smoke are locked into a habit which they find is difficult to break or not worthwhile breaking. Clinical surveys have shown, and the Surgeon General of the United States has announced, that cigarette smoking is detrimental to one's health. So it is that the enjoyment of cigarettes, and the habit of cigarette smoking, can lead to fatal lung cancer.

To avoid such serious consequences, filters have been developed to remove harmful ingredients. It has even been shown that cigarette holders would also tend to remove some of the harmful ingredients because fo the cooling experienced by the smoke in passing through a channel of non-ignition between the ignited hot tip and the lips of the smoker. Often, within the cigarette holder, a porous swab of cotton may be placed in an attempt to filter the smoke. Additionally, it is even possible to dampen such a porous swab in an attempt to wash the smoke. Unfortunately, filters and washes detract from the enjoyment of cigarette smoking, making the habit less enjoyable, but a habit no less.

This inventor has designed a simple baffle which may be inserted into a cigarette holder which has been shown to remove harmful ingredients from the smoke without contributing any distracting taste or otherwise altering the enjoyment of smoking. The main feature of this simple baffle is optimum-size holes which further contribute to the cooling by a throttling process in the cigarette holder. The smoke experiences a free expansion after emerging from these holes in the baffle. It is a wellknown principle of refrigeration that a free expansion results in cooling. This cooling is adequate to cause a precipitation of some of the irritating and less enjoyable ingredients in the smoke. Hence, the baffle does not detract from the enjoyment of smoking and it has been shown to remove some of the deleterious ingredients in cigarette smoke.

DETAILED DESCRIPTION OF EMBODIMENT

Figure 1:
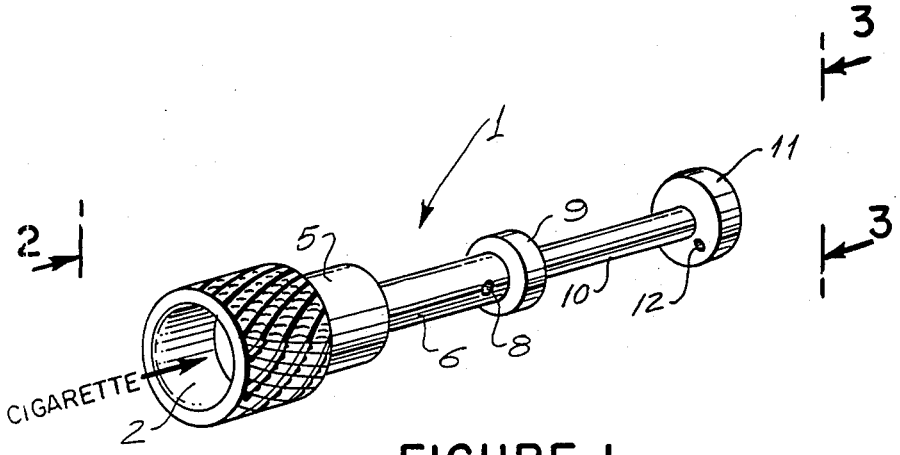
FIG. 1. A blow-up of a cigarette holder insert.
Figure 2:
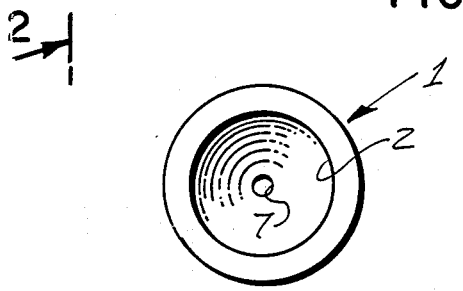
FIG. 2. A diametrical section of insert from the cigarette end.
Figure 3:
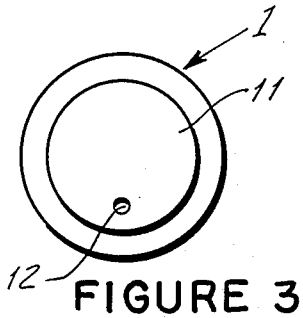
FIG. 3. A mouth piece end-on view.
Figure 4:
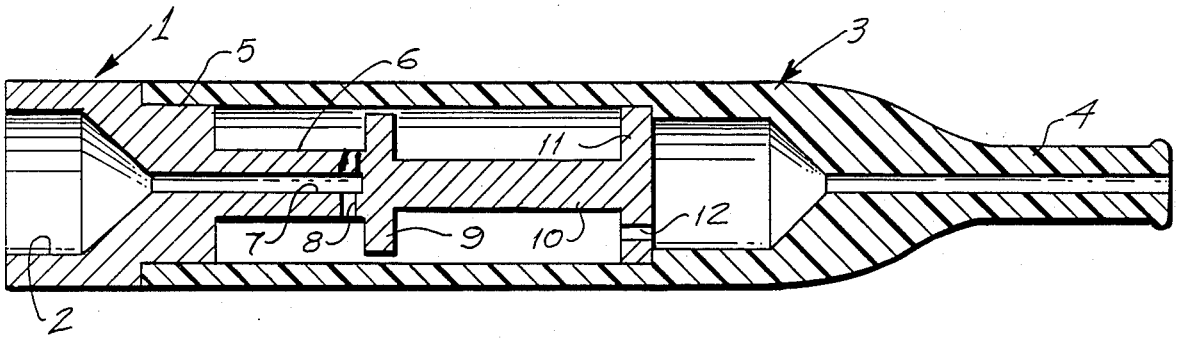
FIG. 4. A cross-section view of the insert in the cigarette holder.

The entire system comprises a cigarette which is placed into the insert, 1, which is seated into the receptacle, 2, of cigarette holder, 3, as shown in FIG. 4. The cigarette and holder, 3, are illustrated for purposes of clarity and are not part of the invention. Cigarettes of varying lengths but generally all of the same diameter are available on the market as are cigarette holders in which the invention the insert, 1, may be seated with said cigarette attached. As aforementioned, the hot end of the cigarette is where the smoke is created which is drawn from the lip end of the cigarette and said smoke passes through the insert, 1, which has been seated in a snug fit into the holder, 3; the smoke exits from the holder at the mouthpiece, 4, and into the respiratory system of the smoker. The embodiment of the insert which the inventor developed was machined out of brass. However, this specification is not limited to brass or any other metal and it is conceived that the insert could be molded of plastic or other moldable material, so as to be lowcost and expendable. The brass insert herein described is very durable and may be easily washed and maintained as a personal possession of a user. For aesthetic reasons, the exterior wall of the receptacle, 2, has been diamond-knurled. Said receptacle holds the lip end of the cigarette. Adjacent to the receptacle, 2, is a shoulder, 5, which grasps the cigarette holder, 3, in a tight friction fit so that the insert, 1, would not slip out of the cigarette holder because of gravity alone. There is a hollow extension, 6, which is a tube which has a axial hole, 7. At the extreme end of the hollow extension, 6, is a diametrical hole, 8, which goes through a diameter of said hollow extension, 6. At the end of said hollow extension is a disk-like baffle, 9, which has an outside diameter which is less than the inside diameter of the cigarette holder, 3, so as to create an annular gap between said baffle and inside wall of said cigarette holder. After the baffle, 9 there is a solid extension, 10, which is a continuation of the hollow extension, 6, which had been bisected by the baffle 9. The solid extension is a solid cylinder. At the extreme end of the solid extension, 10, is a disk which acts as a seal, 11. This seal also seats tightly into the interior of the cigarette holder, 3, but also has a vent hole, 12.

With the cigarette placed in the insert at the receptacle, 2, and the insert, 1, seated tightly into the cigarette holder, 3, smoke drawn through the cigarette passes through the axial hole, 7, of the hollow extension, 6, and exits through the diametrical hole 8. The smoke then passes around the baffle, 9, through the annulus gap comprising the space between the outside circumference of said baffle, 9, and the inner wall of the cigarette holder, 3. The smoke is then sucked parallel to said solid extension, 10, to the seal, 11. As aforementioned, this end disk of the seal, 11, is tightly seated against the inside wall of the cigarette holder, 15. The smoke then enters the mouthpiece, 4, of the cigarette holder by exiting through the vent hole, 12.

Experiment has indicated the optimum size hole is made by a number 52 drill. When the smoker inhales, the smoke is drawn into the axial hole, 7, and exits from the complimentary orifices of the diametrical hole, 8. The smoke is not confined to the chamber defined by the physical contours of the insert and the interior structure of the cigarette holder. A small negative pressure gradient exists in the chamber defined by the baffle, 9, and the seal, 11, parallel with the solid extension, 10. The smoke then passes through the vent hole, 12, in the seal, 11, and enters the final chamber area defined by the interior of the far end of the cigarette holder, 3, between the seal, 11, and the mouthpiece, 4. Each of these aforementioned chambers act as expansion volumes with their own negative pressure gradients. After the cigarette has been consumed and the insert removed from the cigarette holder, there is clear evidence of tar and smoke deposits which are indicative of the cleaning action contributed by the insert. The insert may be cleaned by any number of techniques compatible with the materials used in the insert. Tests performed indicate no decrease in smoking pleasure or taste occurs as long as the insert is kept clean of stale deposits.

I claim:

1. A insertable cigarette smoke baffle which is dimensioned to be inserted into a cigarette holder and to hold a cigarette comprising:

an insert, with a receptacle for said cigarette at the far end of said insert, said receptacle being dimensioned to retain a lip end of said cigarette in a friction fit, adjacent to said receptacle, a holder shoulder which is reduced in its outside diameter from the outside diameter of said receptacle so that said shoulder engages said cigarette holder in a tight friction fit when inserted into said cigarette holder, a hollow extension tube along the axis of the insert having a small axial hole at its geometric center and extending from said receptacle and shoulder through the length of said hollow extension tube, a small diametrical hole through said hollow extension tube, which intersects said axial hole, a baffle in the shape of a disc perpendicular and concentric to said extension tube, said baffle having a diameter slightly less than the inside diameter of said cigarette holder so as to create an annular gap, a solid extension cylinder perpendicular to said baffle and continuing along the axis of said hollow extension tube, and a seal in the shape of a disc perpendicular and concentric to said solid extension cylinder and said seal having an outside diameter dimensioed to friction fit with the inside of said cigarette holder, said seal having a vent hole penetrating through, so that when a lighted cigarette is placed in said receptacle, and said insert is seated in said cigarette holder, smoke from said cigarette passes through said axial hole, in said hollow extension, exiting said axial hole by said diametrical hole, smoke then passing through annular gap around said baffle and moving parallel to said solid extension towards said seal then passing through said vent hole and exiting into a mouthpiece of said cigarette holder whereby such described passage of said smoke, said smoke experiences several cooling expansions resulting in a partial cleaning of said cigarette smoke.

* * * * *